US008708238B2

(12) United States Patent
Wernke et al.

(10) Patent No.: US 8,708,238 B2
(45) Date of Patent: Apr. 29, 2014

(54) PERSONAL TRANSACTION CARD CARRIER

(75) Inventors: Wendy Chapman Wernke, Fort Wayne, IN (US); Stephanie Lanee Hoffherr, Fort Wayne, IN (US)

(73) Assignee: Vera Bradley Designs, Inc., Fort Wayne, IN (US)

( * ) Notice: Subject to any disclaimer, the term of this patent is extended or adjusted under 35 U.S.C. 154(b) by 181 days.

(21) Appl. No.: 13/446,516

(22) Filed: Apr. 13, 2012

(65) Prior Publication Data

US 2013/0270347 A1 Oct. 17, 2013

(51) Int. Cl.
*G06K 7/00* (2006.01)

(52) U.S. Cl.
USPC ..... 235/486; 235/487; 235/380; 283/61; 428/63; 428/78

(58) Field of Classification Search
USPC ..... 235/486, 487, 380; 283/61; 428/63, 78
See application file for complete search history.

(56) References Cited

U.S. PATENT DOCUMENTS

| | | | | |
|---|---|---|---|---|
| 2,258,316 | A | 10/1941 | Buxton | |
| D319,345 | S * | 8/1991 | Rayburn | D6/630 |
| 5,506,395 | A | 4/1996 | Eppley | |
| 5,760,381 | A | 6/1998 | Stich et al. | |
| 5,842,629 | A * | 12/1998 | Sprague et al. | 229/71 |
| 5,868,498 | A * | 2/1999 | Martin | 383/11 |
| 5,918,909 | A | 7/1999 | Fiala et al. | |
| 5,975,302 | A | 11/1999 | Young | |
| 6,315,206 | B1 * | 11/2001 | Hansen et al. | 235/487 |
| 7,070,095 | B1 | 7/2006 | Gandel et al. | |
| D527,897 | S * | 9/2006 | Gonzalez | D3/247 |
| 7,124,955 | B2 | 10/2006 | Lasch et al. | |
| 7,137,552 | B1 | 11/2006 | Lasch et al. | |
| 7,147,151 | B2 | 12/2006 | Lasch et al. | |
| 7,213,764 | B2 | 5/2007 | Lasch et al. | |
| 7,278,584 | B1 | 10/2007 | Gandel et al. | |
| 7,383,989 | B2 | 6/2008 | Lasch et al. | |
| 7,520,439 | B1 | 4/2009 | Gandel et al. | |
| 7,540,426 | B1 | 6/2009 | Gandel et al. | |
| 7,631,812 | B2 | 12/2009 | Williams et al. | |
| 7,721,956 | B2 | 5/2010 | Williams et al. | |
| 2003/0093931 | A1 | 5/2003 | Cuff | |
| 2004/0146688 | A1 * | 7/2004 | Treat | 428/78 |
| 2004/0148837 | A1 | 8/2004 | Lewis | |
| 2007/0089999 | A1 | 4/2007 | Decker et al. | |
| 2008/0163964 | A1 * | 7/2008 | Brannon | 150/147 |
| 2009/0065111 | A1 | 3/2009 | Ohayon et al. | |
| 2011/0048594 | A1 | 3/2011 | Arnone | |
| 2013/0014867 | A1 * | 1/2013 | Newingham | 150/147 |
| 2013/0170938 | A1 * | 7/2013 | Lowden | 414/800 |

FOREIGN PATENT DOCUMENTS

| | | |
|---|---|---|
| EP | 0 515 327 | 11/1992 |
| JP | 2011-125538 | 6/2011 |
| WO | 99/02063 | 1/1999 |

OTHER PUBLICATIONS

Corresponding U.S. Appl. No. 29/418,246, filed Apr. 13, 2013.

* cited by examiner

*Primary Examiner* — Allyson Trail
(74) *Attorney, Agent, or Firm* — Faegre Baker Daniels LLP

(57) ABSTRACT

A personal card carrier is configurable into open and closed positions, in which both broad faces of a contained card are effectively covered and protected against loss in the closed position, but are uncovered in the open position such that a data-embedded portion of the card is presentable to a card reader without necessitating removal of the card from the carrier.

20 Claims, 9 Drawing Sheets

PERSONAL TRANSACTION CARD CARRIER

BACKGROUND

1. Technical Field

The present disclosure relates to carriers for personal effects, e.g., wallets, clutches and purses, and, more particularly, to personal carriers with a selectively accessible card holding pocket.

2. Description of the Related Art

Transaction cards carrying data are currently in widespread use around the world. For example, one common application of transaction cards is financial account management cards, such as credit cards and bank cards. The data associated with such financial management cards includes account numbers and related customer information, which can be used in conjunction with a worldwide network of card reading machines to pay for goods, conduct banking activities and transfer funds. The card reading machines have varying configurations designed to read and/or record the data associated with the card, including credit card readers at customer checkouts within stores, automatic bank teller machines (ATM's), and other devices.

Other applications for data-containing transaction cards include: identification, such as driver licenses and government-issued identification cards; employee access cards, for managing employee access and movement around employer property; student identifications, for managing individualized access to school campuses and student services; and other cards used for identification and/or the rendering of services. Yet another use of transaction cards includes customer loyalty cards, which are sometimes used by retailers to collect customer preference data at a point of sale.

One common method for associating data with a card is a magnetic strip overlaid onto a portion of one of the card's two broad faces. This magnetic strip can be passed through a card reader, such as by "swiping" the card along a unidirectional path through the card reader, i.e., from a reader inlet to a reader outlet. Typically, a user performs such swiping motion by grasping the nonmagnetic body of the card and passing the magnetic strip through the reader.

Another data associating technology includes bar codes, which may be printed on a portion of one face of the card and optically scanned by a bar code reader. Yet another data associating technology is radio frequency identification (RFID), in which the card includes an RFID "tag" containing an electromagnetic field coil. When the RFID tag is placed to into an electromagnetic field, the coil is induced to emit a coded identification number which may be read by the reader device.

For the magnetic strip and bar code data association methods, the strip or bar code must be physically presented to the reader device, and may not be covered or concealed. For RFID embedding technologies, the associated data may be read even if the RFID tag is covered, provided such covering does shield the RFID tag from the electromagnetic field.

Moreover, the magnetic strip method of associating data with cards is the predominant method utilized for credit cards and bank cards, which in turn are the predominant transaction cards in present circulation. Accordingly, substantial design efforts have been focused on providing systems for easily and efficiently carrying and presenting cards having data associated with the cards via magnetic strips.

For example, wallets and/or purses commonly include one or more card pockets designed to securely retain a standard-size transaction card within the wallet or purse until needed, at which time the card may be removed from the pocket, presented to a card reader, and then replaced. However, repeated removal and replacement of the card from the wallet card pocket increases the potential for the card to be damaged, lost, or misplaced.

Other designs include card holders which cover only a portion of the card while another portion of the card protrudes from the card holder to allow it to communicate with appropriate device interfaces. Such designs leave the information association technology, such as a magnetic strip, permanently exposed. Such card holders are often attached to lanyards, keychains or the like, and therefore render the card and, in particular, the magnetic strip, vulnerable to damage and abrasion during transport and storage.

What is needed is an improvement over the foregoing.

SUMMARY

The present disclosure provides a personal card carrier configurable into open and closed positions, in which both broad faces of a contained card are effectively covered and protected against loss in the closed position, but are uncovered in the open position such that a data-containing portion of the card is presentable to a card reader without necessitating removal of the card from the carrier.

To achieve this arrangement of open and closed configurations, the card may be contained in a high friction card pocket disposed at the edge of a card-carrying flap of the personal card carrier, such that a data interface protrudes beyond the edge of the card-carrying flap. The card-carrying flap is foldably or hingedly connected with a card carrier body, which in turn is foldably or hingedly connected to the carrier body. The flaps may be folded over the card to completely cover the exposed card faces. More particularly, when the first flap is folded into abutting engagement with the carrier body, one entire broad face of the card contained within the high-friction pocket abuts the material of the central body, such that the central body presents a barrier against abrasion for one of the two broad faces of the card. The cover flap, which is foldably or hingedly connected to the central body opposite the first flap, may then be folded over the first flap to effectively cover the remaining exposed broad face of the card and thereby present a physical barrier to abrasion or damage of the second exposed broad face.

Further, the spacing of the central body of the personal card carrier between the hinges or folds connecting the central body to the first and second flaps may be designed to prevent migration of the card out of the pocket on the first flap when the personal card carrier is in the fully closed position, thereby preventing inadvertent loss of the card when the personal card carrier is closed.

In one form thereof, the present invention provides a personal card carrier for use in carrying a transaction card having a first broad face and a second broad face, the carrier comprising: a central body defining a pair of edges, the central body having a carrier flap pivot at one of the pair of edges and a cover flap pivot at the other of the pair of edges; a carrier flap pivotably connected to the central body via the carrier flap pivot, the carrier flap pivotable about the carrier flap pivot between a closed carrier configuration and an open carrier configuration, the carrier flap comprising: a card pocket protruding inwardly from an edge of the carrier flap and including an opening disposed along the edge of the carrier flap, the card pocket sized to receive the transaction card along an insertion/removal direction, the edge of the carrier flap disposed adjacent to the central body in the closed carrier configuration with the opening of the card pocket adjacent to the central body, and the edge of the carrier flap spaced from the central body in the open carrier configuration such that the opening of the card pocket opens away from the central body, and the insertion/removal direction defined by the card pocket is unimpeded by the central body; and a cover flap pivotably connected to the central body via the cover flap pivot, the cover flap pivotable about the cover flap pivot between a closed cover configuration and an open cover configuration, wherein the cover flap is one of abutting and adjacent to the central body in the closed cover configuration such that a space adjacent the opening of the card pocket is substantially covered by the cover flap when the cover flap is in the closed cover configuration; whereby the personal card carrier is adapted to cover the first and second broad faces of the transaction card when the cover flap and the carrier flap are in their respective closed configurations.

In another form thereof, the present invention provides a personal card carrier system comprising: a transaction card having a first broad face and an opposing second broad face each defining first and second dimensions perpendicular to one another; a personal card carrier comprising: a central body defining a pair of edges, the central body having a carrier flap pivot at one of the pair of edges and a cover flap pivot at the other of the pair of edges; a carrier flap pivotably connected to the central body via the carrier flap pivot to define a carrier flap pivot axis, the carrier flap pivotable about the carrier flap pivot between a closed carrier configuration and an open carrier configuration; a cover flap pivotably connected to the central body via the cover flap pivot to define a cover flap pivot axis, the cover flap pivotable about the cover flap pivot between a closed cover configuration and an open cover configuration; a card pocket protruding inwardly from an edge of the carrier flap and including an opening disposed along the edge of the carrier flap, the card pocket sized to receive a captured portion of the transaction card along an insertion/removal direction while leaving an exposed portion of the transaction card protruding outwardly from the edge of the carrier flap; the central body, the carrier flap and the cover flap dimensioned to cover the first and second broad faces when the carrier flap is in the closed carrier configuration and the cover flap is in the closed cover configuration; and the exposed portion of the transaction card uncovered when the carrier flap is in the open carrier configuration, such that a portion of the first and second broad faces of the transaction card are exposed.

In yet another form thereof, the present invention provides a method of transferring data from a card to a card reader, the method comprising: opening a personal card carrier by unfolding a cover flap and a carrier flap from a central body of the personal card carrier, the step of opening comprising exposing opposing broad faces of the card while leaving the card secured in a card pocket formed on the carrier flap; grasping the personal card carrier by one or more of the central body, the carrier flap, and the cover flap; presenting, during the step of grasping, a data-containing portion of the card with the card reader to transfer data between the card and the card reader, the step of engaging occurring while the card remains secured in the card pocket; and closing the personal card carrier by folding the cover flap and the carrier flap into a closed configuration, the step of closing comprising covering the opposing broad faces of the card which were previously exposed in the opening step.

BRIEF DESCRIPTION OF THE DRAWINGS

The above mentioned and other features and advantages of the present disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the invention in any manner.

DETAILED DESCRIPTION

Figure 1:
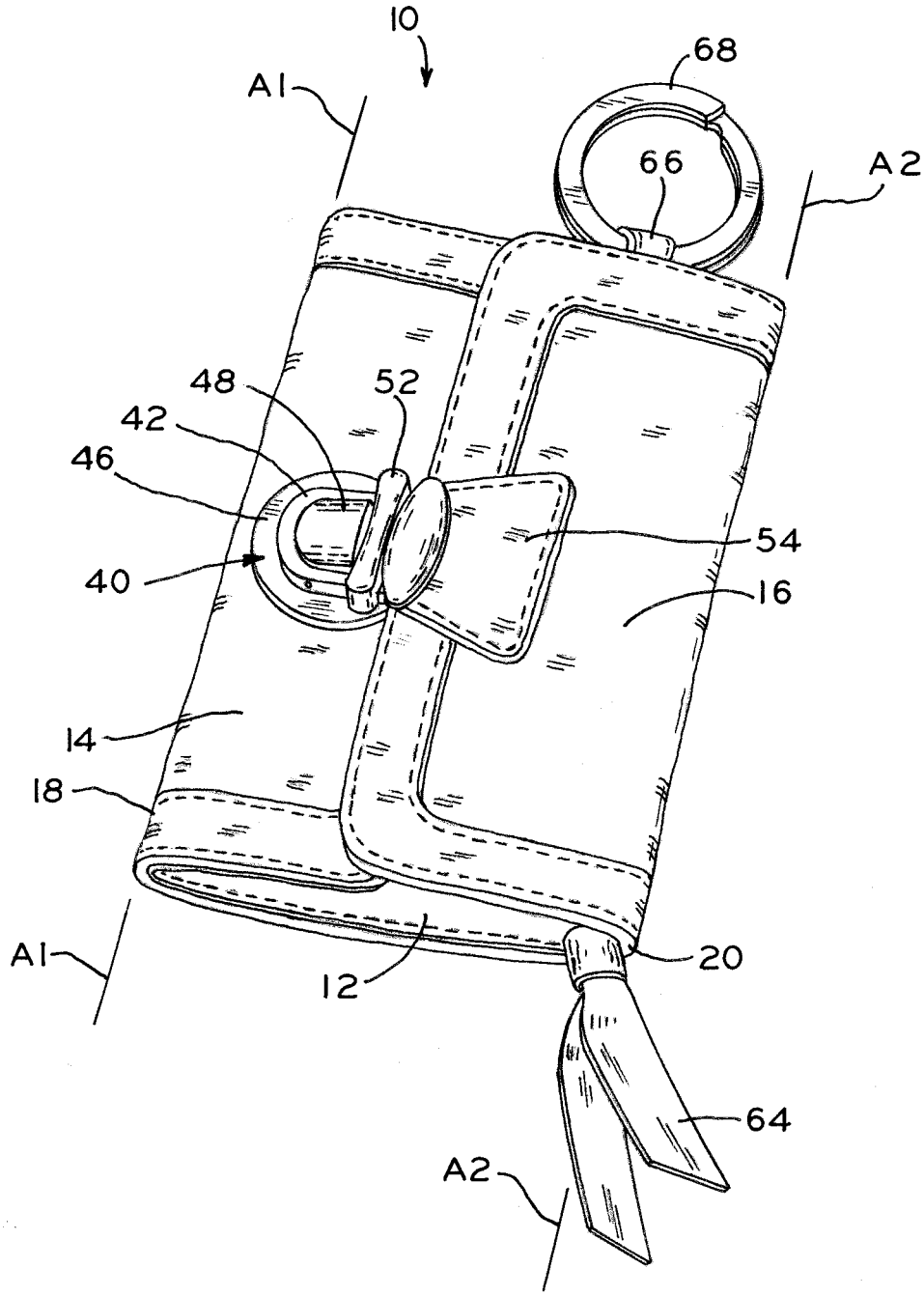
FIG. 1 is a perspective view of a personal care carrier made in accordance with the present disclosure, shown in the fully closed configuration.
Figure 2:
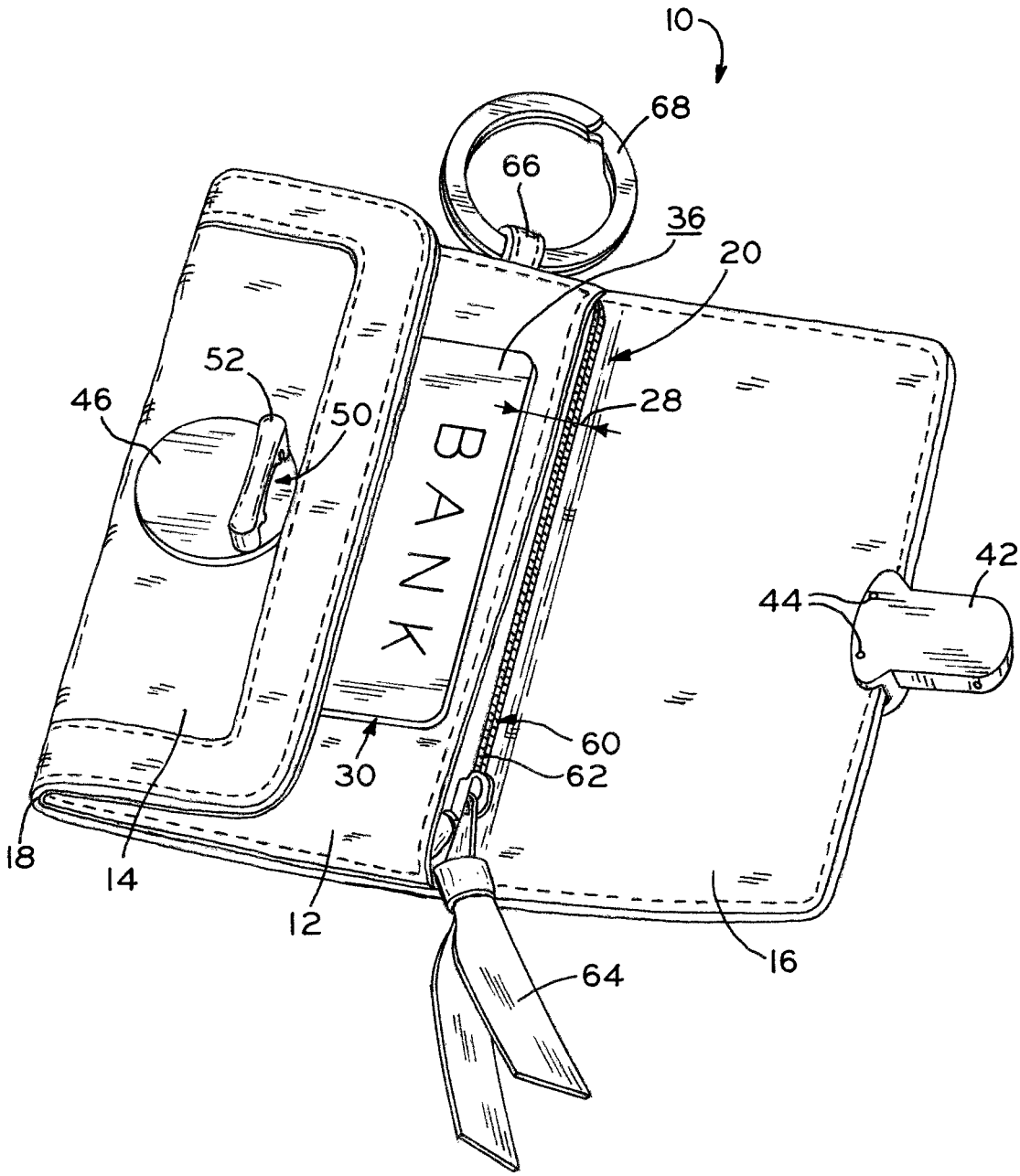
FIG. 2 is another perspective view of the personal card carrier shown in FIG. 1, with one of two hingedly connected flaps arranged in an open position and the other flap in the closed position.
Figure 3:
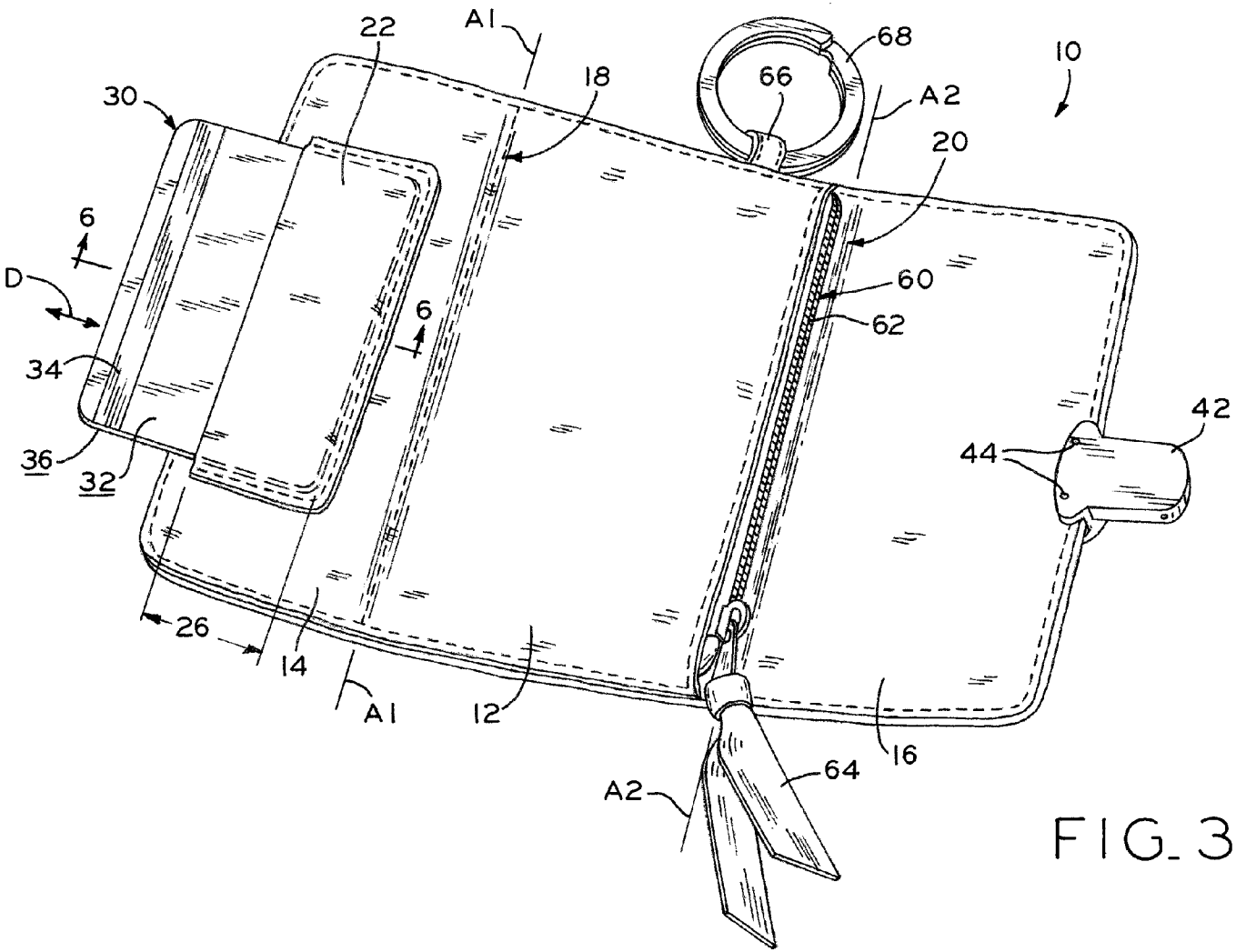
FIG. 3 is another perspective view of the personal card carrier shown in FIGS. 1 and 2, with the flaps of the personal card carrier in a fully open configuration.
Figure 4:
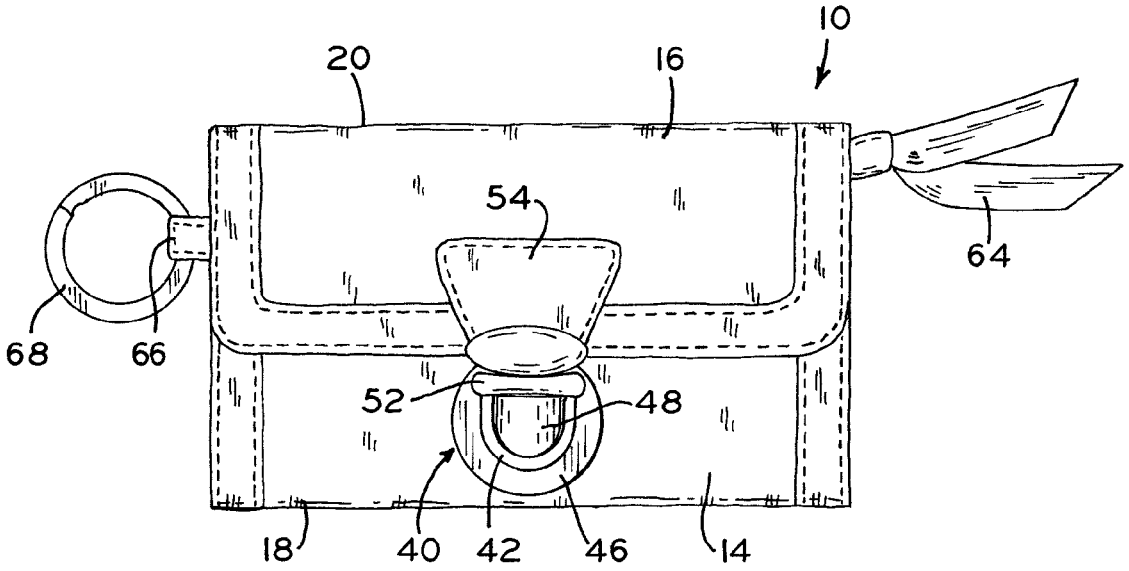
FIG. 4 is a front, elevation view of the personal card carrier shown in FIG. 1.
Figure 5:
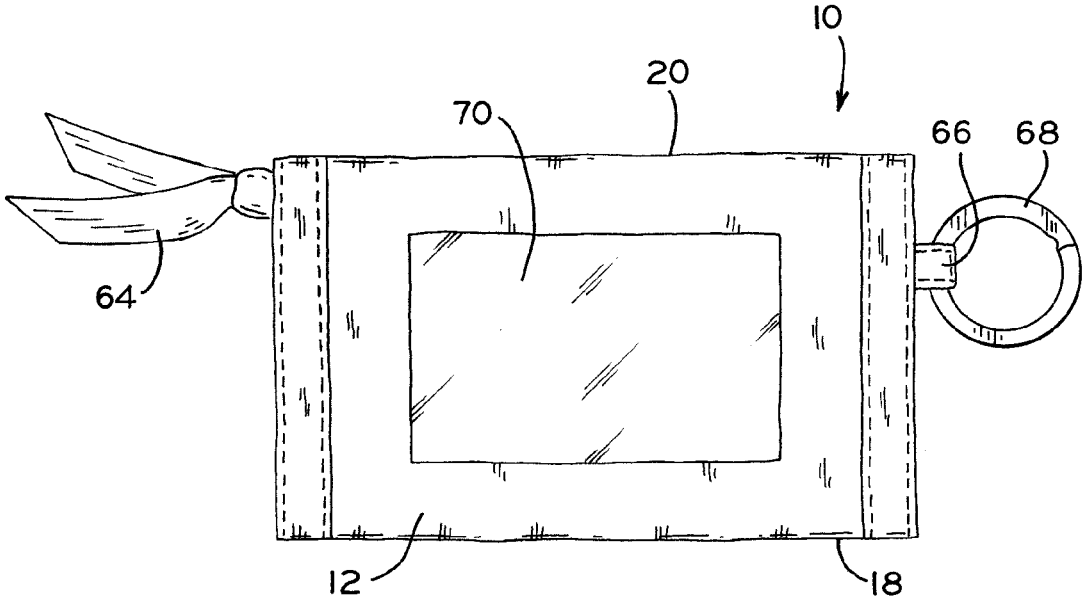
FIG. 5 is a rear, elevation view of the personal card carrier shown in FIG. 1.

The present disclosure provides personal card carrier, such as wallet 10 shown in FIGS. 1-3, which secures data containing card 30 (FIGS. 2 and 3) against loss and damage when in a closed configuration, but allows easy and efficient access to the data containing portion of card 30 (e.g., magnetic strip 34 shown in FIG. 3) without necessitating removal of card 30 from wallet 10. Although a personal card carrier in accordance with the present disclosure is described below in the context of wallet 10, other designs of personal card carriers may be provided such as wristlets, purses, handbags, clutches, totes and the like.

In the closed configuration, both broad faces of card 30 (i.e., printed face 36 and the opposing data containing face 32) are effectively covered by central body 12, carrier flap 14 and cover flap 16. In the closed configuration, the interior space allotted for containing and protecting card 30 is sized to present a physical barrier to removal of card 30 from pocket 22 (FIG. 3), thereby preventing potential accidental loss of card 30 during transport of wallet 10. In the open configuration (FIG. 3) both broad faces 32, 36 of card 30 are uncovered and available for presentation to card reader 38 (FIG. 11) without removing card 30 from pocket 22.

Referring to FIG. 3, card 30 having magnetic strip 34 on data carrier face 32 is illustrated received within pocket 22 of wallet 10. Pocket 22 is sized to snugly receive a portion of card 30, such as about half of card 30, while leaving the remainder of both data carrier face 32 and printed face 36 uncovered, exposed and projecting from carrier flap 14 (FIG. 2). Such exposure is accomplished by arranging the opening into pocket 22, into which card 30 is received, along or near the edge of carrier flap 14. As described in detail below, this pocket arrangement and resulting exposure of the broad faces 32, 36 of card 30 allows magnetic strip 34 to be swiped through card reader machine 38 (FIG. 11) without removing card 30 from pocket 22.

Figure 11:
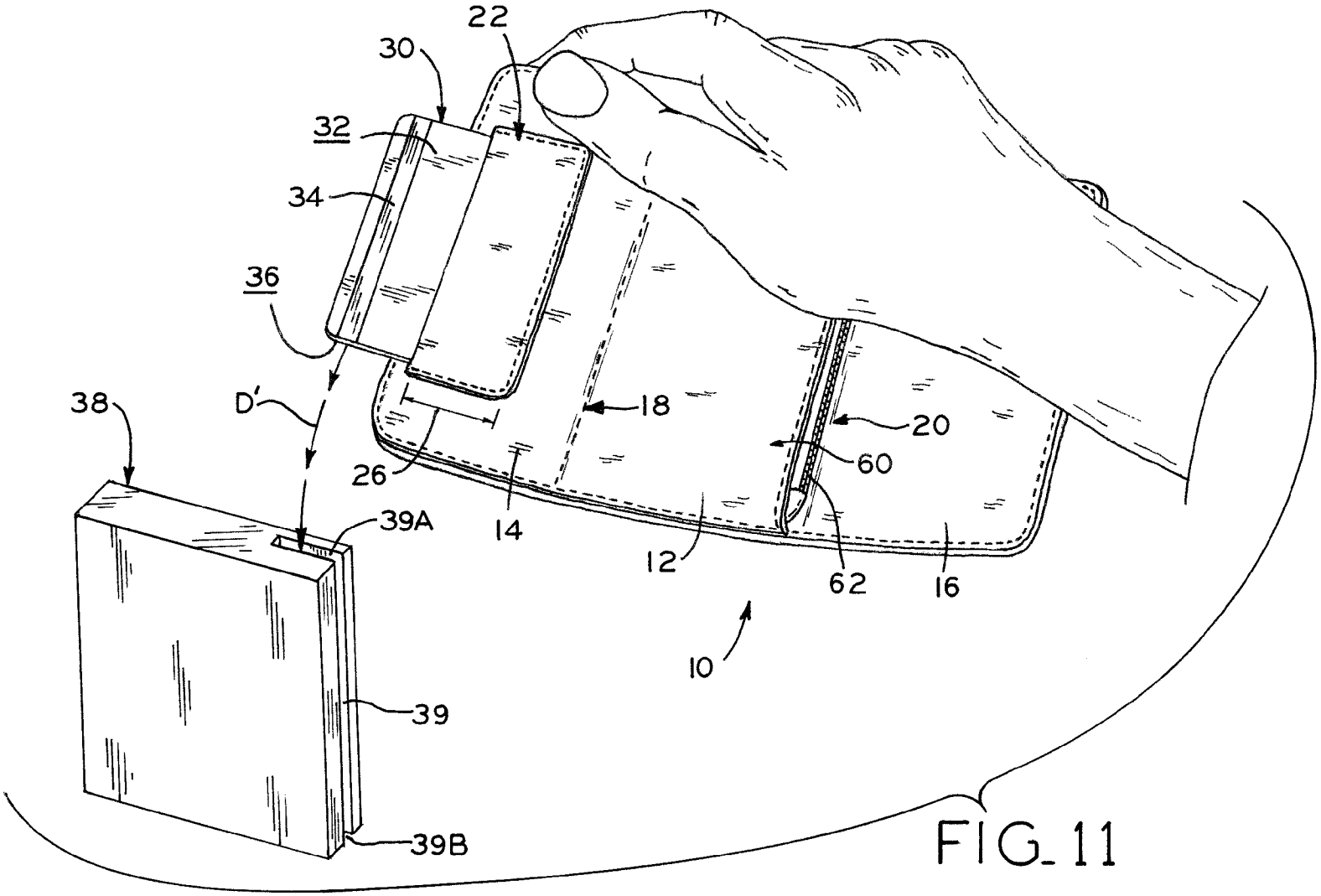
FIG. 11 illustrates a method of use of the personal card carrier shown in FIG. 3.

Optionally, friction strip 24 (FIG. 6) may be disposed within pocket 22. Friction strip 24 provides a tacky, high friction material surface which bears against printed face 36 of card 30 when card 30 is received within pocket 22. As used herein, "high friction" refers to friction which is higher than another material from which at least a portion of the carrier is made. In the context of wallet 10, for example, the material of carrier flap 14 and pocket 22 may be a textile fabric such as cotton, polyester blends, wool, and the like. The friction within pocket 22 may be increased by friction strip 24, which may be any material which provides a higher coefficient of friction compared to a surrounding fabric, for example. Moreover, the amount and nature of the high friction material used for friction strip 24 may be tailored to provide a level of friction sufficient to prevent inadvertent or unintentional slippage of card 30 from pocket 22 during normal use, e.g., when card 30 is inserted, removed, bumped or jostled, inverted, or swiped through card reader 38 (FIG. 11). However, friction strip 24 may also provide friction that is low enough to prevent potential damage to card 30 during insertion or removal, and to avoid unduly hindering intentional insertion and removal of card 30 into and out of pocket 22.

Figure 6:
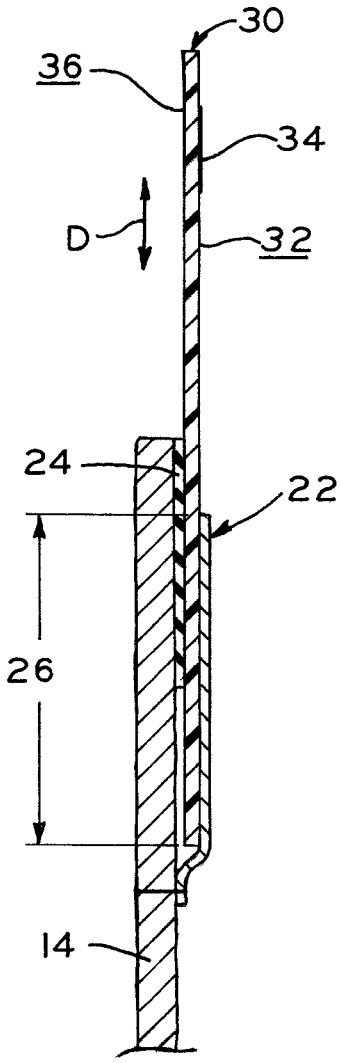
FIG. 6 is a partial section, elevation view of a portion of the personal card carrier shown in FIG. 3, taken along line 6-6 of FIG. 3.

When card 30 is inserted into pocket 22 along direction D (FIGS. 3 and 6), additional insertion force may be employed as needed to overcome the frictional resistance presented by friction strip 24. Once card 30 is fully seated within pocket 22 as shown in FIGS. 3 and 6, this same additional friction provided at the interface of friction strip 24 and printed face 36 presents a resistance to movement of card 30 along direction D, thereby providing additional securement of card 30 within pocket 22. Advantageously, this additional securement acts to prevent accidental movement of card 30 out of pocket 22 during use and transport of wallet 10.

The illustrative embodiment of FIG. 6 shows printed face 36 bearing against friction strip 24, and friction strip 24 in turn sewn into (and therefore fixed with respect to) carrier flap 14. However, it is contemplated that card 30 may be reversed within pocket 22 such that data carrier face 32 bears against friction strip 24, or that friction strip 24 may be attached to the material forming pocket 22 rather than carrier flap 14. In an alternative exemplary embodiment shown in FIG. 9, a pair of friction strips 24 are attached to both sides of pocket 22 and therefore are positioned to bear against both printed face 36 and data carrier face 32.

In an exemplary embodiment, friction strip 24 is made of silicone, which has been found to provide an ideal frictional interaction with the plastic material of typical transaction cards 30. However, it is contemplated that friction strip 24 may be made of a material other than silicone, such as rubber, leather, suede, polymers or foams, for example. Moreover, any high friction material arrangement bearing against one or both of broad faces 32, 36 of card 30 may be employed in a similar fashion. For example, the material of pocket 22 and/or carrier flap 14 may itself be formed from a high friction material, thereby obviating the use of a separate friction strip 24. In addition, the pressure applied to one or both of broad faces 32, 36 may be increased to provide increased friction, such as by positioning a pair of opposing-polarity magnets on either side of pocket 22 to "pinch" card 30 within pocket 22, using elastic or other resiliently deformable material for pocket 22, or using a rigid material for pocket 22 that is sized to provide an tight or interference fit with card 30 upon insertion into pocket 22.

As noted above, wallet 10 may be reconfigured into a closed configuration in which faces 32, 36 of card 30 are protected against abrasion or other damage, and in which flaps 14, 16 present a physical barrier to removal of card 30 from pocket 22. Thus, wallet 10 may be closed to insure against loss or damage of card 30 during transport and storage.

Central body 12 of wallet 10 includes a pair of mutually opposed edges, with carrier flap 14 connected to one of the edges via carrier flap pivot 18 and cover flap 16 connected to the other of the edges via cover flap pivot 20. As used herein, the term "pivot" refers to any relative angular movement between two bodies about a pivot axis. Structures for pivotably connecting such bodies to one another include mechanical hinges, material folds and the like.

Carrier flap 14 of wallet 10 includes pocket 22 which is structured and arranged to allow selective, rapid deployment of magnetic strip 34 of card 30 while also protecting broad faces 32, 36 of card 30 against abrasion or other damage. In an exemplary embodiment, the opening of pocket 22 is positioned substantially coincident with, or along, the edge of carrier flap 14 generally opposite carrier flap pivot 18. This arrangement allows card to protrude outwardly from carrier flap 14 such that broad faces 32, 36 are both substantially exposed, while keeping card 30 in secure fixed engagement with carrier flap 14.

Carrier flap pivot 18 defines carrier flap pivot axis A1 and cover flap 20 defines cover flap pivot A2 (FIGS. 1 and 3), with pivots A1, A2 substantially parallel to one another. To reconfigure wallet 10 from the open configuration of FIG. 3 to the closed configuration of FIGS. 1, 7 and 8, carrier flap 14 is first folded about carrier flap pivot 18 by about 180 degrees, into the configuration shown in FIG. 2. When so folded, data carrier face 32 and magnetic strip 34 bear against or are adjacent to the material of central body 12. In the illustrative embodiment of FIG. 3, carrier flap 14 is pivoted to a fully open configuration. In this fully open configuration, the inner face of carrier flap 14 (i.e., the face contiguous with data carrier face 32 of card 30) and the inner face of central body 12 (i.e., the face abutting data carrier face 32 when in the closed configuration) define an angle of about 180 degrees, thereby necessitating a 180-degree angular sweep of carrier flap 14 about carrier flap pivot 18 to toggle carrier flap 14 to the closed configuration. It is contemplated that any angle may be traversed by carrier flap 14 to toggle between its open and closed configurations, provided the angle is sufficient to expose data carrier face 32 for interaction with card reader 38 (FIG. 11). This angle may be as small as about 45 degrees or smaller, depending on the location and orientation of card reader 38.

Advantageously, when carrier flap 14 is disposed in the closed configuration shown in FIG. 2 and described above, central body 12 covers data carrier face 32 and presents a physical barrier to damage or abrasion of data carrier face 32 from foreign objects, e.g., keys or other objects which may be carried in a bag or purse together with wallet 10.

Figure 7:
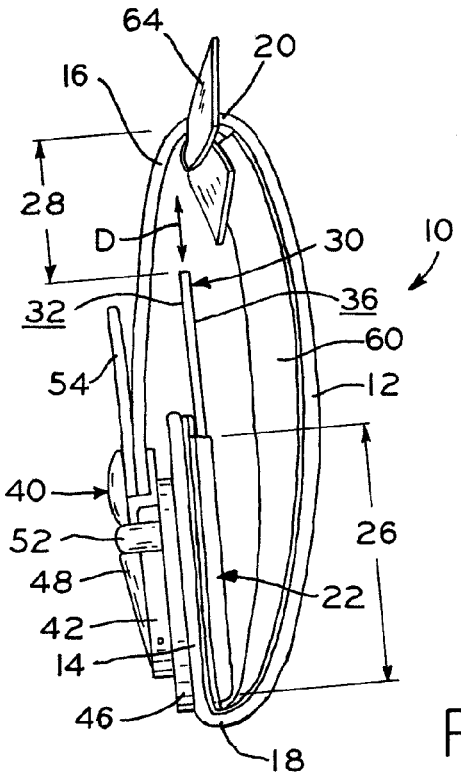
FIG. 7 is a right side, elevation view of the personal card carrier shown in FIG. 1.
Figure 8:
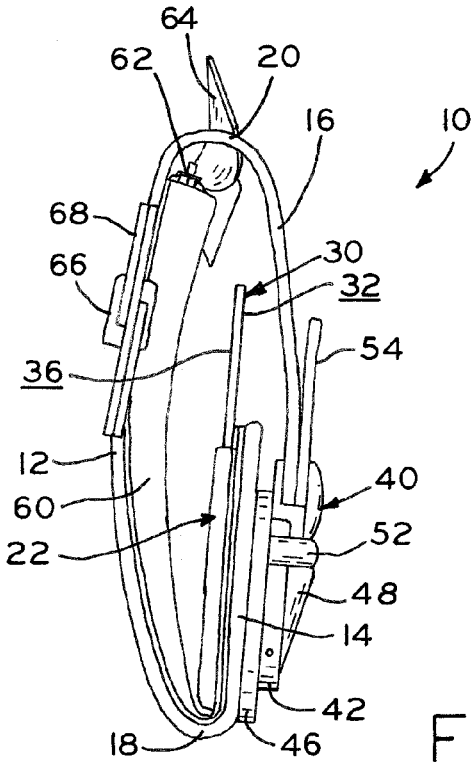
FIG. 8 is a left side, elevation view of the personal card carrier shown in FIG. 1.

Next, cover flap 16 is folded about cover flap pivot 20 by about 180 degrees, such that cover flap 16 effectively covers printed face 36. As shown in FIGS. 1, 7 and 8, cover flap 16 bears against or is adjacent to printed face 36 in the closed configuration, thereby presenting a physical barrier to damage or abrasion of printed face 36 in a similar fashion to the material of central body 12 and data carrier face 32, described above. It is contemplated that the angular sweep necessary to toggle cover flap 16 between its open and closed configurations may be substantially smaller than 180 degrees, similar to carrier flap 14 discussed above. The minimum angular sweep of cover flap 16 may be as small as 45 degrees or smaller, provided the angle is sufficient to allow card 30 to pivot the open configuration without interference from cover flap 16.

In an exemplary embodiment, cover flap 16 slightly overlaps the edge of carrier flap 14 including the opening to pocket 22 when cover flap 16 is in the closed configuration. This coverage of the space around the opening of pocket 22 both secures the closure of wallet 10, and ensures coverage of printed face 36 without any coverage gaps. Thus, when card 30 is received within pocket 22 and wallet 10 is in the closed configuration, broad faces 32, 36 of card 30 are substantially sequestered from their surroundings.

Optionally, clasp 40 may be used to secure wallet 10 in the closed configuration, as illustrated in FIG. 1. Clasp 40 includes male clasp portion 42 fixed to cover flap 16, such as by screws or pins 44 (FIG. 2), and female clasp portion 46 similarly secured to carrier flap 14. In an exemplary embodiment, male clasp portion 42 includes spring loaded button 48 which, after passing through aperture 50 formed in female clasp portion 46, springs into a locked configuration in which button 48 bears against stanchion 52 of female clasp portion 46 to lock wallet 10 in the closed configuration. A user may unlock clasp 40 by depressing button 48 against its internal spring bias such that male clasp portion 42 may be passed back through aperture 50 and disengaged therefrom. Pull tab 54 (FIG. 1) may be fixed to male clasp portion 42 to aid in engagement and disengagement of clasp 40.

Turning now to FIGS. 7 and 8, card 30 is cradled within a protected space formed by central body 12, carrier flap 14 and cover flap 16 when wallet 10 is in the closed configuration. Further, pocket 22 cooperates with the spatial configuration of carrier flap pivot 18 and cover flap pivot 20 to prevent card 30 from being removed from pocket 22 when wallet 10 is in the closed configuration. More particularly, when card 30 is inserted into pocket 22 along direction D (FIGS. 3 and 6), the leading edge of card 30 moves a total captured distance 26 corresponding to the depth of pocket 22, i.e., starting from initial engagement between broad card faces 32, 36 and pocket 22 and ending when card 30 is fully seated in pocket 22. Conversely, card 30 must be advanced along direction D by at least a distance equal to captured distance 26 in order to remove card 30 from pocket 22.

However, as best seen in FIG. 7, only a limited amount of potential travel along direction D by card 30 is permitted when wallet 10 is in the closed configuration. By design of the spatial configuration of pocket 22 relative to pivots 18, 20 in the closed configuration, this limited amount of travel is equal to clearance distance 28 (FIG. 7) which is substantially less than captured distance 26. More specifically, carrier flap pivot 18 and cover flap pivot 20 define longitudinal pivot axes A1, A2 respectively, with axes A1, A2 substantially parallel to insertion/removal direction D defined by pocket 22. Further, carrier flap pivot 18 is positioned to place the exposed edge of card 30 near cover flap pivot 20 when wallet 10 is in the closed configuration (as shown in FIGS. 2, 7 and 8).

Therefore, the potential travel of card 30 within wallet 10 is insufficient to allow card 30 to be freed from pocket 22 when wallet 10 is in the closed configuration. More specifically, card 30 can only move by clearance distance 28 until encountering a physical barrier in the form of the material of cover flap 16 and/or central body 12 in the region of cover flap pivot 20. Because clearance distance 28 is substantially less than captured distance 26, card 30 will encounter a physical barrier to further movement along direction D prior to becoming fully dislodged from pocket 22. Further, because the sides of pocket 22, i.e., the portions of pocket 22 extending along a direction generally parallel to direction D, are sewn shut or otherwise affixed to the material of carrier flap 14 (as shown in FIG. 3, card 30 cannot be removed along any direction other than direction D and therefore is captured within wallet 10 when in the closed configuration.

In one exemplary embodiment, wallet 10 is sized to receive a card having a faces 32, 36 defining a height of approximately 2⅛ inches and a width of approximately 3⅜ inches (where height and width are measured perpendicular to one another along faces 32, 36 in a conventional fashion). As this is a standard card size for various types of financial services cards, identification cards, customer loyalty cards, and the like, wallet 10 is universal to a large plurality of cards currently in use. Where this "standard-size" card pocket 22 is used in the context of the exemplary design of FIG. 9, friction strips 24 may each be 2⅞ inches long and ⅜ inch high. As noted herein, however, any size card may be used in accordance with the present disclosure, such as keyring-type cards measuring about 1 inch by 2 inches and commonly used for customer loyalty card applications, with the associated card pocket and friction strips sized accordingly.

For such standard size cards, captured distance 26 may be as little as ¾ inch, ⅞ inch or 1⅛ inches, and as large as 1¼ inches, 1⅜ inches, or 1½ inches, or may be any value within any range defined by the foregoing values. Clearance distance 28 may be less than captured distance 26 by as little as ⅛ inch, ¼ inch, or ⅜ inch, or as may be as large as ½ inch, ⅝ inch, or ¾ inch, or may be any value within any range defined by the foregoing values. In one exemplary embodiment shown in FIG. 9 and utilizing two friction strips 24 positioned to bear against both broad faces 32, 36 of card 30, captured distance 26 may be between 13⁄16 inch and ⅞ inch. Advantageously, these dimensions for pocket 22 and the corresponding locations of pivots 18, 20 render wallet 10 compatible with standard-size, transaction cards in widespread use, while leaving magnetic strip 34 accessible to card reader 38 (shown in FIG. 11 and described below) when wallet 10 in the open configuration (FIG. 3).

However, it is contemplated that other dimensions may be used to accommodate other cards or documents, such as non-standard card sizes, passports and the like. Moreover, it is also contemplated that such dimensions may be altered as required or desired for a particular design, such as where the data association with card 30 is accomplished by other than magnetic strip 34, such as by an optically readable barcode, printed text or an RFID tag, for example. It is noted that where wallet 10 is used in conjunction with cards whose data is embedded by an RFID tag, the material of wallet 10 may provide electromagnetic shielding to prevent unwanted scanning of the embedded data. Advantageously, the quick-access design described herein may be employed to remove such electromagnetic shielding and therefore allow the RFID tag to be selectively exposed to a reader in a similar fashion to magnetic strip 34 and reader 38.

Wallet 10 may optionally include a variety of other features to enhance the versatility and usability thereof For example, an internal pocket 60 may be provided in central body 12 and toggled between open and closed positions by zipper 62 including zipper pull 64. Zipper 62 and zipper pull 64 are shown in their open configurations in FIGS. 1-5, such that zipper pull 64 and keyring 68 are on the same side of wallet 10 when zipper 62 is closed. However, it is of course contemplated that zipper 62 may open in either direction. Pocket 60 may be sufficiently sized to retain a plurality of other cards, coins and paper currencies, and the like. A key ring tab 66 may be sewn or otherwise affixed to central body 12 to allow attachment of wallet 10 to other structures, such as keys or other bags or carriers.

Figure 9:
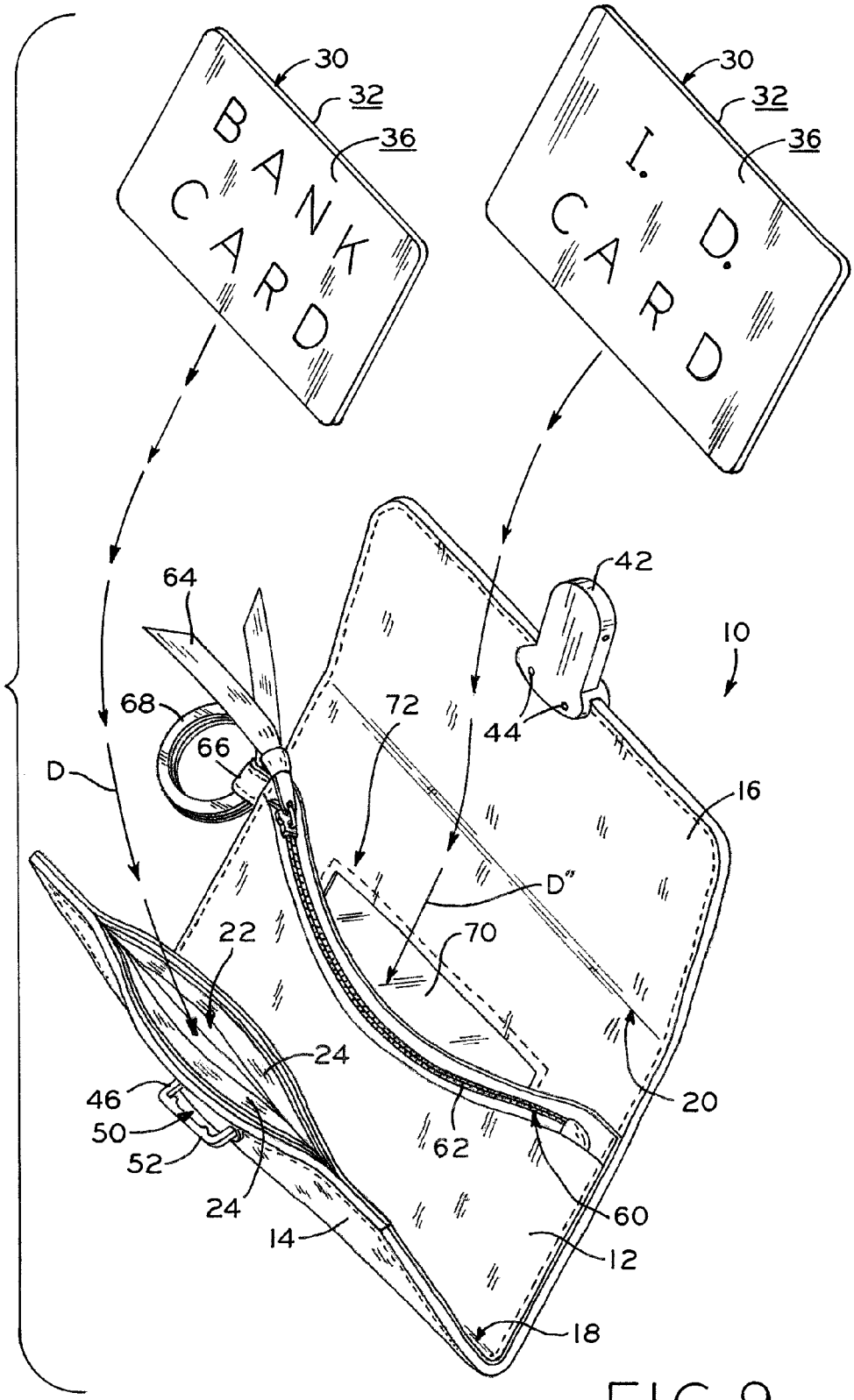
FIG. 9 is a perspective view of the personal card carrier shown in FIG. 1, illustrating insertion of two cards therein.

A card display window 70 (FIG. 5) may be provided in the outer face of central body 12, i.e., the face of central body 12 opposite carrier and cover flaps 14, 16 when wallet 10 is in the closed configuration. Display window 70 may be transparent or translucent to allow a card contained within card window pocket 72 (e.g., an identification card) to be viewed without being removed from wallet 10. Referring now to FIG. 9, another card 30 may be placed into window pocket 72 via an ingress/egress slot formed on the interior face of central body 12 adjacent zipper 62, such that a card is inserted into window pocket 72 along direction D". When carrier flap 14 is in its fully opened configuration (FIG. 3) or fully closed configuration (FIG. 2), direction D" is substantially parallel to direction D. Thus, similar to pocket 22, a card contained within window pocket 72 cannot be removed from wallet 10 when in the closed configuration, thereby securing card 30 against accidental loss and damage when contained therein. Card 30 is inserted into pocket 72 along direction D" is shown as an ID card, which advantageously is viewable through window 70. However, it is contemplated that any card 30 may be placed within either of pockets 22.

Figure 10:
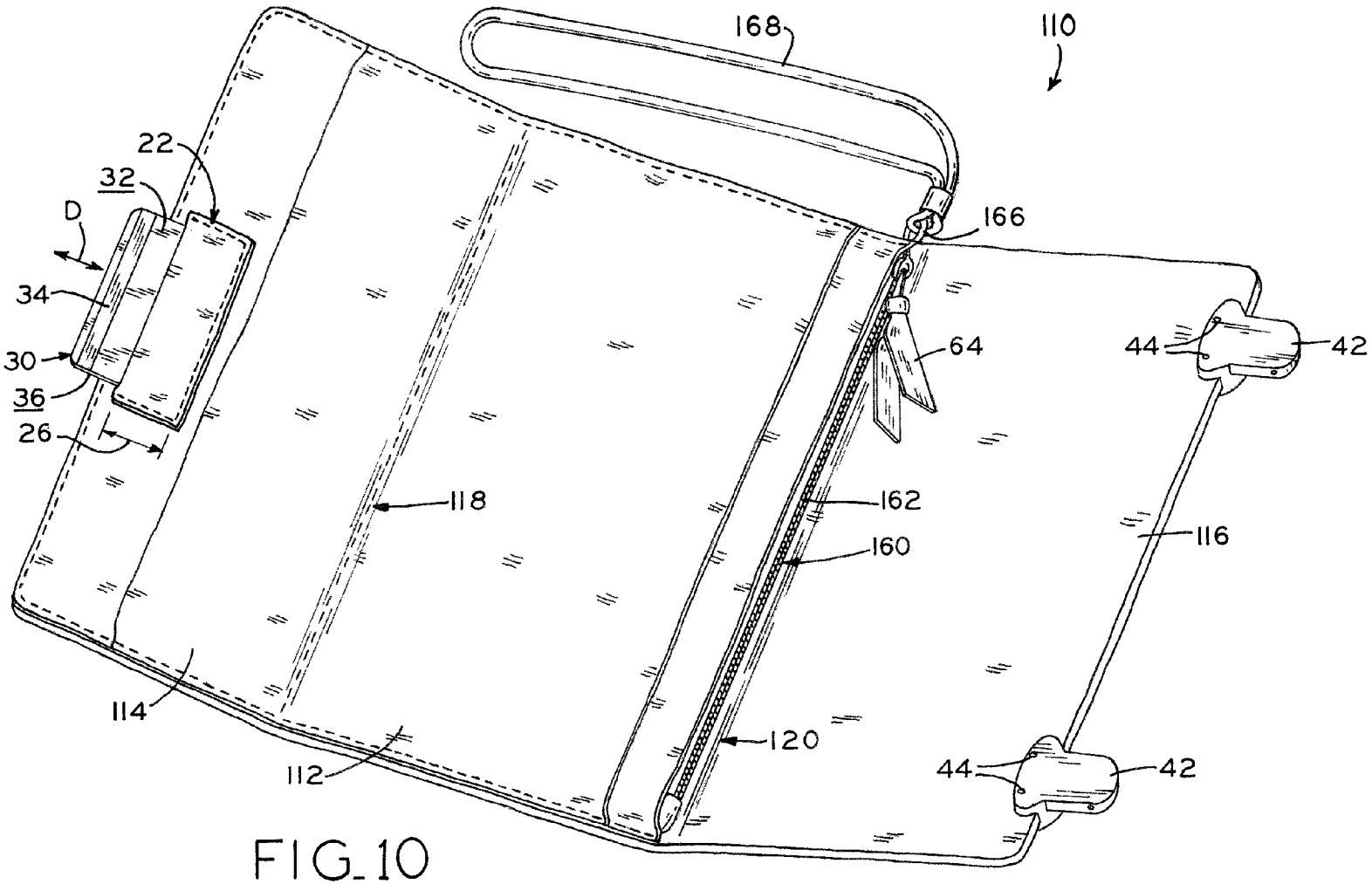
FIG. 10 is a perspective view of an alternative personal card carrier design, shown in the fully opened configuration.

Pocket 22 in accordance with the present disclosure may be incorporated into any number of other personal card carrier designs in accordance with the present disclosure, including wristlets, purses, handbags, clutches, totes, lanyards, duffels, backpacks, lunch-type bags, and the like. For example, as illustrated in FIG. 10, pocket 22 may be incorporated into clutch 110. Clutch 110 is similar to wallet 10 described above, with structures of clutch 110 corresponding to similar structures denoted by corresponding reference numerals of wallet 10 except as otherwise noted. For example, data carrier face 32 and printed face 36 remain exposed in a similar fashion to wallet 10, with magnetic strip 34 available for presentation to card reader 38 (FIG. 11). Further, carrier flap pivot 118 and cover flap pivot 120 are arranged in conjunction with the overall size of carrier flap 114 and cover flap 116 to ensure that the broad faces 32, 36 of card 30 will be effectively covered by the material of central body 112, carrier flap 114 and cover flap 116 when clutch 110 is in the closed configuration, in similar fashion to wallet 10 described above. The spatial configuration of carrier flap and cover flap pivots 118, 120 ensures that a clearance distance analogous to clearance distance 28 will be less than captured distance 26 when clutch 110 is in its closed configuration.

However, clutch 110 is larger in size compared to wallet 10, such that internal pocket 160 is also enlarged and capable of containing larger and more numerous items. Carrying strap 168 replaces key ring 68 to facilitate stand-alone carrying of clutch 110 secured to the user's wrist or shoulder. A pair of male clasp portions 42 are provided, such that a pair of clasps 40 secure clutch 110 in the closed position rather than the single clasp 40 described above.

Moreover, it is contemplated that any arrangement of pocket 22 with respective carrier flap and cover flap pivots similar to pivots 18, 20, 118, 120 may be utilized to integrate the high security, damage protection, and ease-of-access features of wallets 10 and clutch 110 as described herein.

In use, wallet 10 may be stowed and transported in the closed configuration (FIGS. 1, 7 and 8). When card 30 is needed, such as at a store checkout, restricted building entranceway, cafeteria, or the like, wallet 10 is retrieved from its storage location and is opened, i.e., is reconfigured from the closed configuration of FIG. 1 to the open configuration of FIG. 3 by disengaging clasp 40 and unfolding cover flap 16 and carrier flap 14 to expose data carrier face 32 and printed face 36 of card 30.

The unfolded configuration of wallet 10, ready for use with card reader 38, is shown in FIG. 11. The user may then, grasping wallet 10 by one or more of central body 12, carrier flap 14 and cover flap 16, swipe card 30 through card reader 38 along direction D' such that magnetic strip 34 passes through slot 39 formed in card reader 38 along a path spanning card inlet 39A and card outlet 39B. As card 30 passes through slot 39, the data associated with magnetic strip 34 is transferred to card reader 38. Wallet 10 may then be folded back into the closed configuration as described above, and stowed for further transport and future use.

Advantageously, the direction D of insertion of card 30 into pocket 22 is perpendicular to the direction D' utilized when engaging card 30 with card reader 38. This perpendicularity of the card insertion and use directions, combined with the optional high friction provided by friction strip 24 (FIG. 6 and described above), mitigates or eliminates the risk of card 30 migrating out of pocket 22 during use.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A personal card carrier for use in carrying a transaction card having a first broad face and a second broad face, said carrier comprising:

a central body defining a pair of edges, said central body having a carrier flap pivot at one of said pair of edges and a cover flap pivot at the other of said pair of edges;

a carrier flap pivotably connected to said central body via said carrier flap pivot, said carrier flap pivotable about said carrier flap pivot between a closed carrier configuration and an open carrier configuration, said carrier flap comprising:

a card pocket protruding inwardly from an edge of said carrier flap and including an opening disposed along said edge of said carrier flap, said card pocket sized to receive the transaction card along an insertion/removal direction, said edge of said carrier flap disposed adjacent to said central body in said closed carrier configuration with said opening of said card pocket adjacent to said central body, and said edge of said carrier flap spaced from said central body in said open carrier configuration such that said opening of said card pocket opens away from said central body, and said insertion/removal direction defined by the card pocket is unimpeded by said central body; and a cover flap pivotably connected to said central body via said cover flap pivot, said cover flap pivotable about said cover flap pivot between a closed cover configuration and an open cover configuration, wherein said cover flap is one of abutting and adjacent to said central body in said closed cover configuration such that a space adjacent said opening of said card pocket is substantially covered by said cover flap when said cover flap is in said closed cover configuration;

whereby said personal card carrier is adapted to cover the first and second broad faces of the transaction card when said cover flap and said carrier flap are in their respective closed configurations.

2. The personal card carrier of claim 1, wherein said carrier flap further comprises at least one friction strip of material disposed in said card pocket.

3. The personal card carrier of claim 1, wherein said insertion/removal direction of the transaction card is substantially perpendicular to a longitudinal extent of said carrier flap pivot.

4. The personal card carrier of claim 1, wherein said pair of edges of said central body are mutually opposed.

5. The personal card carrier of claim 1, wherein said cover flap overlaps said carrier flap when said cover flap and said carrier flap are in their respective closed configurations.

6. The personal card carrier of claim 1, wherein said card pocket is about 3⅜ inches wide.

7. The personal card carrier of claim 1, wherein said card pocket defines a pocket depth, said pocket depth sized to establish a captured distance equal to a maximum movement of the transaction card along the insertion/removal direction.

8. The personal card carrier of claim 7, wherein said captured distance is between ¾ inch and 1½ inches.

9. The personal card carrier of claim 7, in combination with a transaction card having a card height, said transaction card protruding outwardly from said card pocket when received therein to define a clearance distance between said transaction card and said cover flap pivot, said clearance distance less than said captured distance, whereby removal of said transaction card from said card pocket is blocked when said carrier flap and said cover flap are in their respective closed configurations.

10. The personal card carrier of claim 9, wherein said captured distance is between ¾ inch and 1½ inches and said clearance distance is less than said captured distance by between ⅛ inch and ¾ inch.

11. A personal card carrier system comprising:

a transaction card having a first broad face and an opposing second broad face each defining first and second dimensions perpendicular to one another;

a personal card carrier comprising:

a central body defining a pair of edges, said central body having a carrier flap pivot at one of said pair of edges and a cover flap pivot at the other of said pair of edges;

a carrier flap pivotably connected to said central body via said carrier flap pivot to define a carrier flap pivot axis, said carrier flap pivotable about said carrier flap pivot between a closed carrier configuration and an open carrier configuration;

a cover flap pivotably connected to said central body via said cover flap pivot to define a cover flap pivot axis, said cover flap pivotable about said cover flap pivot between a closed cover configuration and an open cover configuration;

a card pocket protruding inwardly from an edge of said carrier flap and including an opening disposed along said edge of said carrier flap, said card pocket sized to receive a captured portion of the transaction card along an insertion/removal direction while leaving an exposed portion of the transaction card protruding outwardly from said edge of said carrier flap;

said central body, said carrier flap and said cover flap dimensioned to cover said first and second broad faces when said carrier flap is in said closed carrier configuration and said cover flap is in said closed cover configuration; and said exposed portion of said transaction card uncovered when said carrier flap is in said open carrier configuration, such that a portion of said first and second broad faces of said transaction card are exposed.

12. The personal card carrier system of claim 11, wherein:

said card pocket defines a captured distance equal to a maximum movement of the transaction card along the insertion/removal direction with said transaction card engaged with said card pocket, said captured distance less than at least one of said first and second dimensions of said transaction card; and said cover flap pivot, said carrier flap pivot and said card pocket arranged to provide a clearance distance along said insertion/removal direction and measured between said transaction card and said cover flap pivot when said cover flap and said carrier flap are in their respective closed configurations, said clearance distance less than said captured distance.

13. The personal card carrier system of claim 12, wherein said captured distance is between ¾ inch and 1½ inches and said clearance distance is less than said captured distance by between ⅛ inch and ¾ inch.

14. The personal card carrier of claim 11, wherein said carrier flap further comprises at least one friction strip of material disposed in said card pocket.

15. The personal card carrier of claim 11, wherein said cover flap overlaps said carrier flap when said cover flap and said carrier flap are in their respective closed configurations.

16. A method of transferring data from a card to a card reader, said method comprising:

opening a personal card carrier by unfolding a cover flap and a carrier flap from a central body of the personal card carrier, said step of opening comprising exposing opposing broad faces of the card while leaving the card secured in a card pocket formed on the carrier flap;

grasping the personal card carrier by one or more of the central body, the carrier flap, and the cover flap;

presenting, during said step of grasping, a data-containing portion of the card with the card reader to transfer data between the card and the card reader, said step of engaging occurring while the card remains secured in the card pocket; and closing the personal card carrier by folding the cover flap and the carrier flap into a closed configuration, said step of closing comprising covering the opposing broad faces of the card which were previously exposed in said opening step.

17. The method of claim 16, wherein said step of engaging further comprises swiping the card through the card reader along a swipe direction, the swipe direction substantially perpendicular to a direction of insertion of the card into the card pocket.

18. The method of claim 16, further comprising, before said step of engaging, the additional step of:

inserting the card into the card pocket such that card protrudes from the card pocket when the card is fully seated in the card pocket.

19. The method of claim 18, wherein said step of inserting the card further comprises leaving exposed a portion of the card including the data-containing portion of the card.

20. The method of claim 19, wherein said step of leaving exposed a portion of the card further comprises leaving one of a magnetic strip, a barcode and an RFID tag readable by the card reader when the personal card carrier is in its open configuration.

* * * * *